US011911676B1

(12) United States Patent
Xiong

(10) Patent No.: US 11,911,676 B1
(45) Date of Patent: Feb. 27, 2024

(54) LIGHTING EFFECT STRUCTURE FOR SANDBAG GAME BOARD

(71) Applicant: Shenzhen Blinngo Technology Co., Ltd., Shenzhen (CN)

(72) Inventor: Wanghui Xiong, Shenzhen (CN)

( * ) Notice: Subject to any disclaimer, the term of this patent is extended or adjusted under 35 U.S.C. 154(b) by 0 days.

(21) Appl. No.: 18/503,328

(22) Filed: Nov. 7, 2023

(51) Int. Cl.
*A63B 67/06* (2006.01)
*A63B 71/06* (2006.01)

(52) U.S. Cl.
CPC ..... *A63B 67/06* (2013.01); *A63B 71/0605* (2013.01); *A63B 71/0622* (2013.01); *A63B 2071/0625* (2013.01)

(58) Field of Classification Search
CPC . A63B 67/06; A63B 71/0605; A63B 71/0622; A63B 2071/0625
See application file for complete search history.

(56) References Cited

U.S. PATENT DOCUMENTS 4,492,581 A * 1/1985 Arai ..... G09B 19/22 463/43
5,785,613 A * 7/1998 Francis ..... A63B 5/22 473/414
5,839,976 A * 11/1998 Darr ..... A63B 5/22 273/237
6,893,264 B2 * 5/2005 Reed ..... G09B 3/00 273/287
8,807,569 B1 * 8/2014 Davis ..... F41J 5/20 473/570
2004/0251631 A1 * 12/2004 Chou ..... A63B 69/0053 273/378
2011/0070981 A1 * 3/2011 Allshouse ..... A63B 63/00 473/476

(Continued)

*Primary Examiner* — Alvin A Hunter
*Assistant Examiner* — Christopher Glenn
(74) *Attorney, Agent, or Firm* — Daniel M. Cohn; Howard M. Cohn

(57) ABSTRACT

The utility model relates to the technical field of throwing toys, and discloses a structure of a lighting effect structure for a sandbag game board. The lighting effect structure for a sandbag game board includes a lighting effect assembly, a sandbag board configured to mount the lighting effect assembly, and a remote control configured to remotely control the lighting effect assembly. The lighting effect assembly for a sandbag game board includes a hole light strip, a board light strip, a sensing detection module configured to detect that a sandbag enters a hole, a vibration detection module configured to detect that the sandbag hits a board, and a voice playback module configured to perform voice prompt in cooperation with the sensing detection module and the vibration detection module. The hole light strip is embedded in an inner part of a hole on the sandbag board, and the board light strip is embedded at an outer edge of the sandbag board. According to a design that the hole light strip and the board light strip are embedded in the sandbag board, appearance of the sandbag board is ensured. Due to disposing of the hole light strip, the board light strip, the laser sensor, the vibration sensor, and the loudspeaker, the lighting effect is displayed and a corresponding voice prompt is played back while the sandbag hits the sandbag board or entering the hole. Therefore, interactivity is high, and interestingness of a sandbag throwing game is improved.

10 Claims, 9 Drawing Sheets

(56) References Cited

U.S. PATENT DOCUMENTS

| | | | | |
|---|---|---|---|---|
| 2015/0054221 | A1* | 2/2015 | Sandman | A63B 60/16 273/402 |
| 2018/0036630 | A1* | 2/2018 | Wilder | H04R 7/045 |
| 2020/0391095 | A1* | 12/2020 | Michael | A63B 71/0622 |
| 2022/0032157 | A1* | 2/2022 | Theobald | G01V 8/12 |
| 2022/0096909 | A1* | 3/2022 | Russell | H05B 47/115 |
| 2023/0059916 | A1* | 2/2023 | Carlay | A63B 67/06 |
| 2023/0065061 | A1* | 3/2023 | Turner | A63B 63/08 |
| 2023/0201698 | A1* | 6/2023 | Jones | A63B 67/06 273/402 |

* cited by examiner

LIGHTING EFFECT STRUCTURE FOR SANDBAG GAME BOARD

TECHNICAL FIELD

The utility model relates to the technical field of throwing toys, and in particular to a lighting effect structure for a sandbag game board.

BACKGROUND

A sandbag is a throwing game. Generally, dry yellow sand or environmental protection plastic particles are filled in a small bag woven of thick cloth, and a volume is slightly larger than a volume of a baseball. With the development and popularity of the sandbag throwing game, there are more demands on decorations of light around a sandbag throwing board. To be specific, not only requirements for lighting and decorations are met, but also DIY customization requirements for personalized lighting effect are met.

A sandbag throwing game board is a board with a hole, provided that a user throws a sandbag into the hole. However, a light strip on an existing sandbag throwing game board is decorative, and cannot participate in a game process. Therefore, display is dull in the game process, interactivity is poor. One end of the light strip is tied on the sandbag throwing game board. As a result, cooperation of the light strip with the sandbag throwing game board is poor, and use of demands cannot be met.

SUMMARY

To achieve the foregoing objective, the utility model provides the following technical solutions: A lighting effect structure for a sandbag game board includes a lighting effect assembly, a sandbag board configured to mount the lighting effect assembly, and a remote control configured to remotely control the lighting effect assembly. The lighting effect assembly for a sandbag game board includes a hole light strip, a board light strip, a sensing detection module configured to detect that a sandbag enters a hole, a vibration detection module configured to detect that the sandbag hits a board, and a voice playback module configured to perform voice prompt in cooperation with the sensing detection module and the vibration detection module. The hole light strip is embedded in an inner part of a hole on the sandbag board, the board light strip is embedded at an outer edge of the sandbag board, and top levels of the hole light strip and the board light strip are the same as a top level of the sandbag board.

As a preferable technical solution of the utility model, the sensing detection module includes a sensor housing disposed at a bottom of the sandbag board, and a plurality of laser sensors disposed in an inner part of the sensor housing. A through hole matching with the hole on the sandbag board is opened in the inner part of the sensor housing, and the plurality of laser sensors are disposed on a circle of the through hole.

As a preferable technical solution of the utility model, the voice playback module includes a loudspeaker housing disposed on the sensor housing. A loudspeaker is disposed in the loudspeaker housing, and there is at least one loudspeaker housing.

As a preferable technical solution of the utility model, the vibration detection module includes a control box disposed at the bottom of the sandbag board, a circuit board is disposed in an inner part of the control box, and a wireless transceiver, a vibration sensor, an LED driver, and a chip are integrated on the circuit board.

As a preferable technical solution of the utility model, a battery that is connected to the circuit board through a circuit is further disposed in the inner part of the control box, and the hole light strip and the board light strip are connected to the LED driver and the chip through a circuit.

As a preferable technical solution of the utility model, the laser sensor and the loudspeaker are connected to the chip through a circuit.

As a preferable technical solution of the utility model, an antenna that is matched with the wireless transceiver is further integrated on the circuit board, and the circuit board is wirelessly connected to the remote control through the wireless transceiver and the antenna.

As a preferable technical solution of the utility model, a power switch that is configured to switch on and off power supplies of the battery and the circuit board, and a control box button that is configured to set lighting effect of the hole light strip and the board light strip are disposed on a side of the control box, and the power switch and the control box button are connected to the chip through a circuit.

As a preferable technical solution of the utility model, an ON button configured to enable a control box and an OFF button configured to disable a detection function are disposed on the remote control, a SELECT button is disposed on the remote control, and the SELECT button is configured to switch lighting effects of the hole light strip and the board light strip.

As a preferable technical solution of the utility model, at least one button group that is configured to set a color of the hole light strip and the board light strip, and a TEAM A button and a TEAM B button that are configured to group a versus mode are disposed on the remote control.

Compared with a conventional technology, the utility model provides a lighting effect structure for a sandbag game board, which has the following beneficial effects:

According to the lighting effect structure for a sandbag game board, the hole light strip and the board light strip are embedded in the sandbag board, appearance of the sandbag board is ensured. Due to disposing of the hole light strip, the board light strip, the laser sensor, the vibration sensor, and the loudspeaker, the lighting effect is displayed and a corresponding voice prompt is played back while the sandbag hits the sandbag board or entering the hole. Therefore, interactivity is high, and interestingness of a sandbag throwing game is improved.

Figure 4:
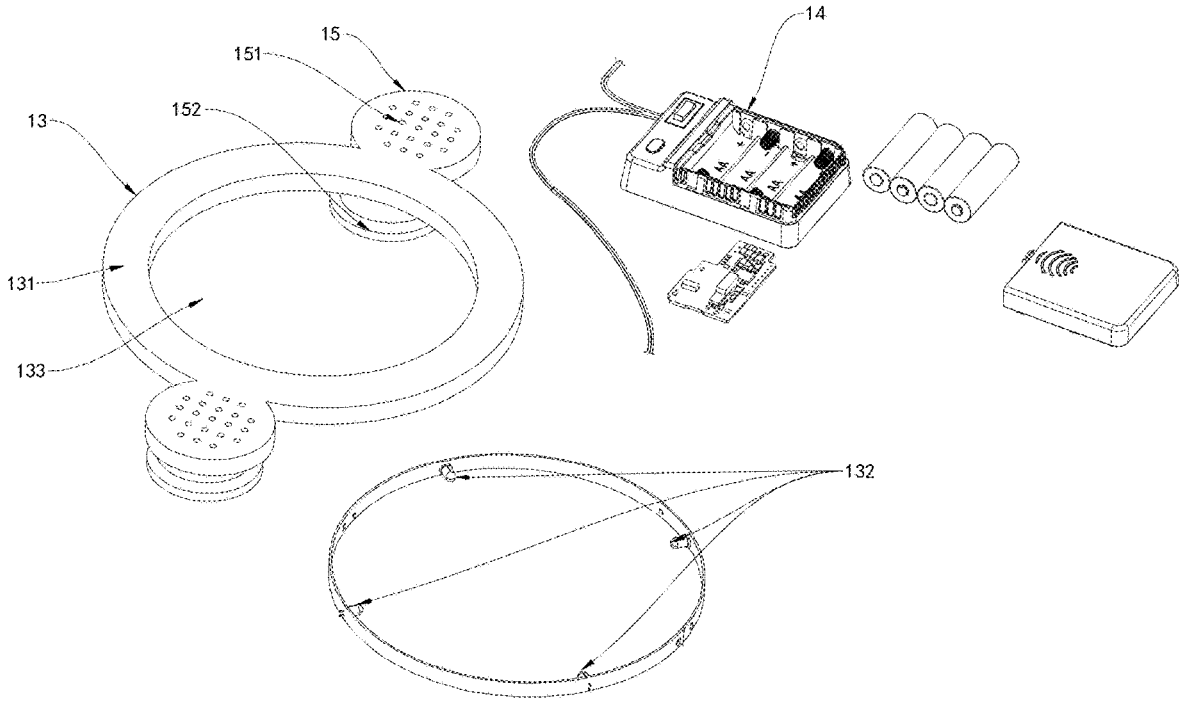
Figure 5:
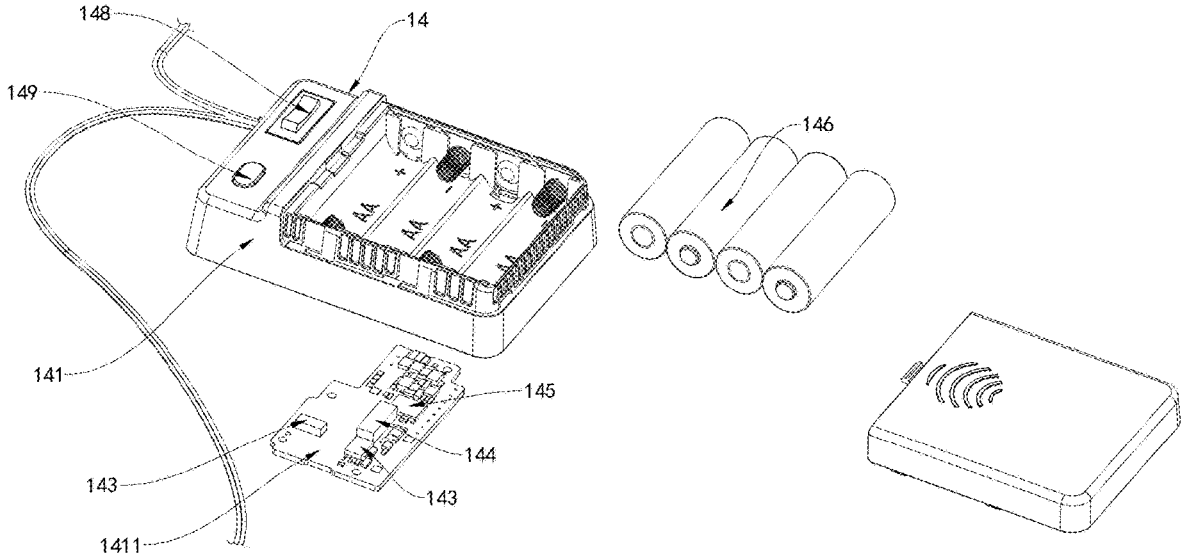
Figure 6:
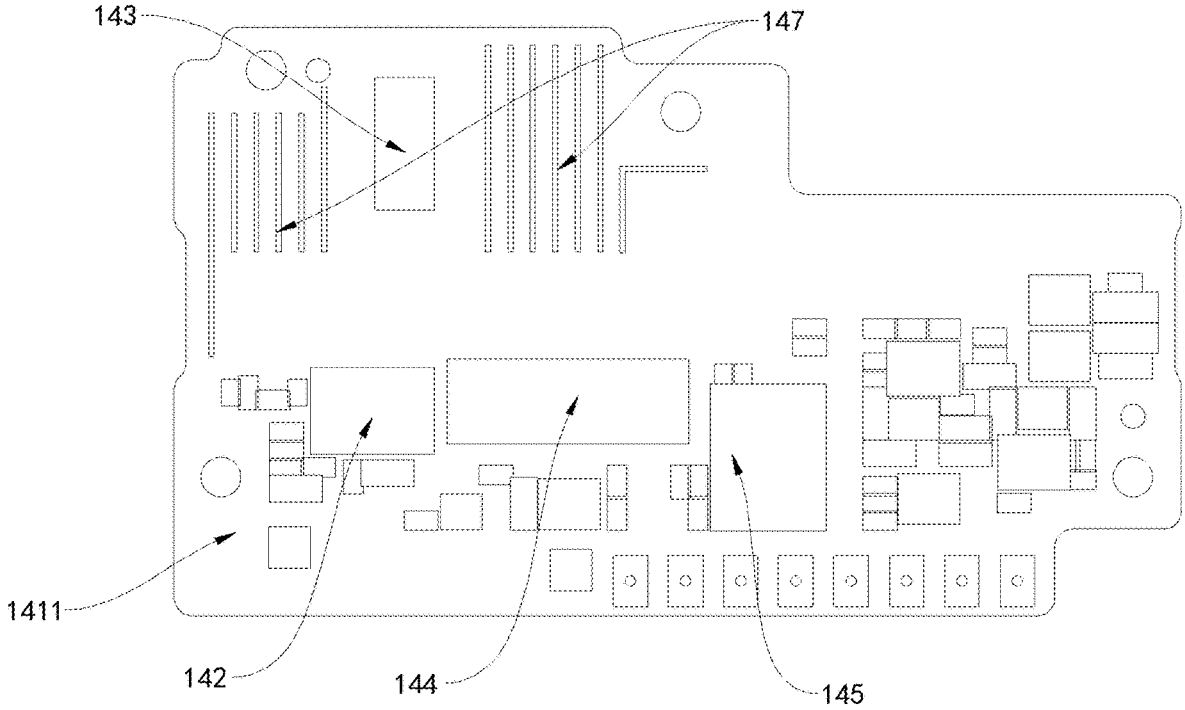
Figure 7:
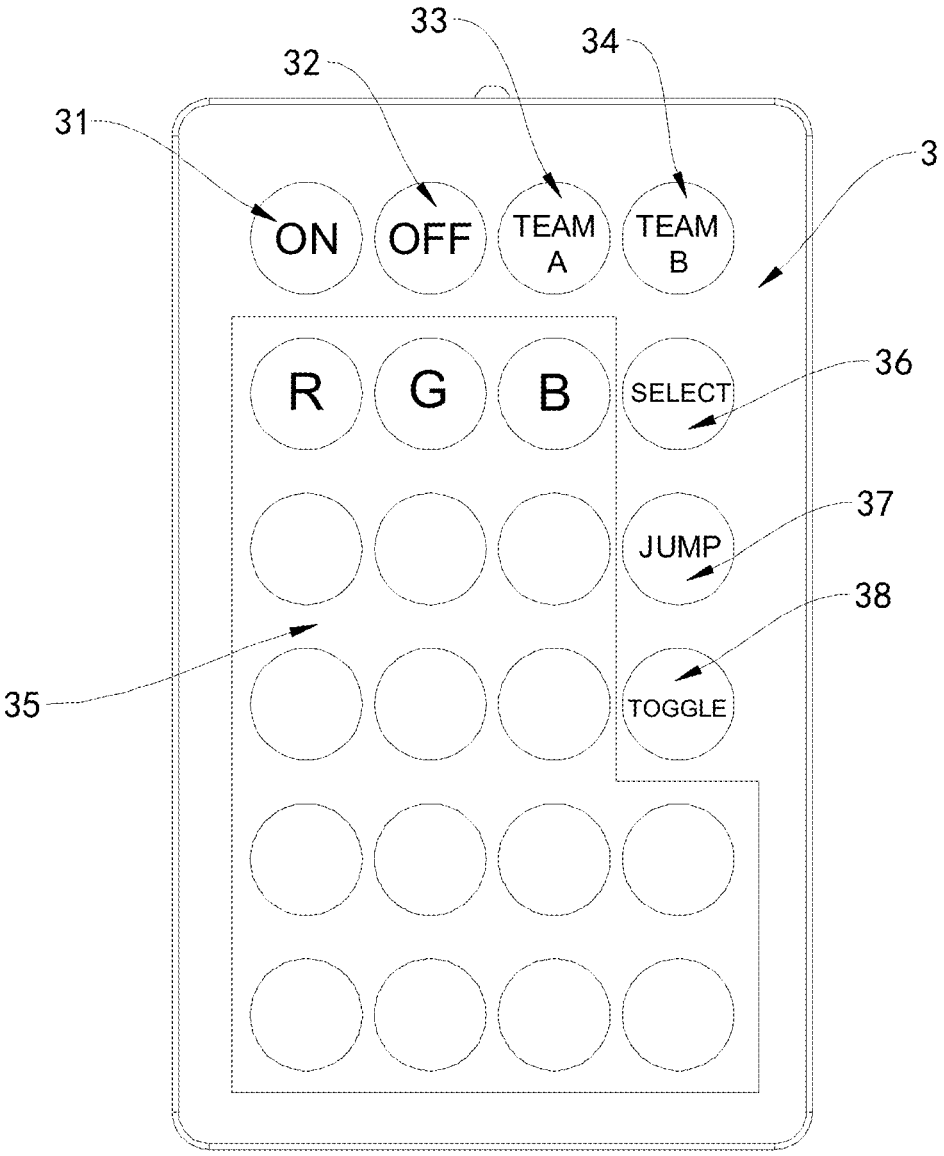
Figure 8:
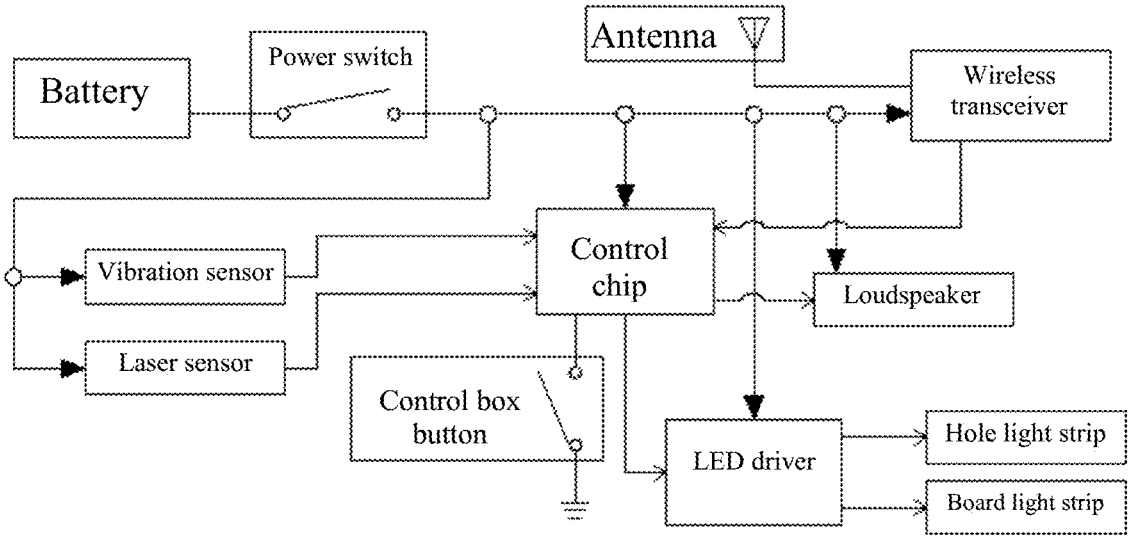
Figure 9:
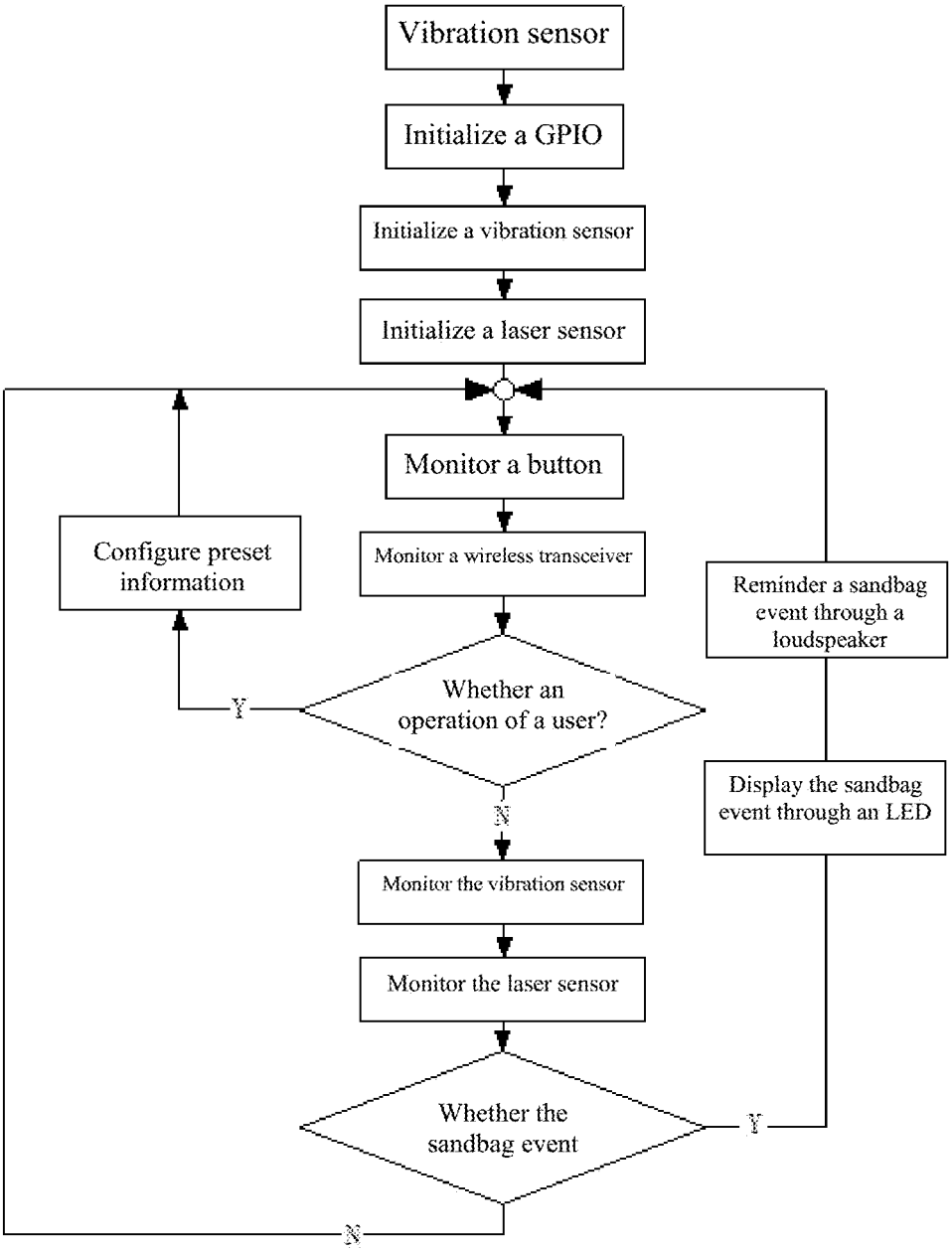
Figure 10:
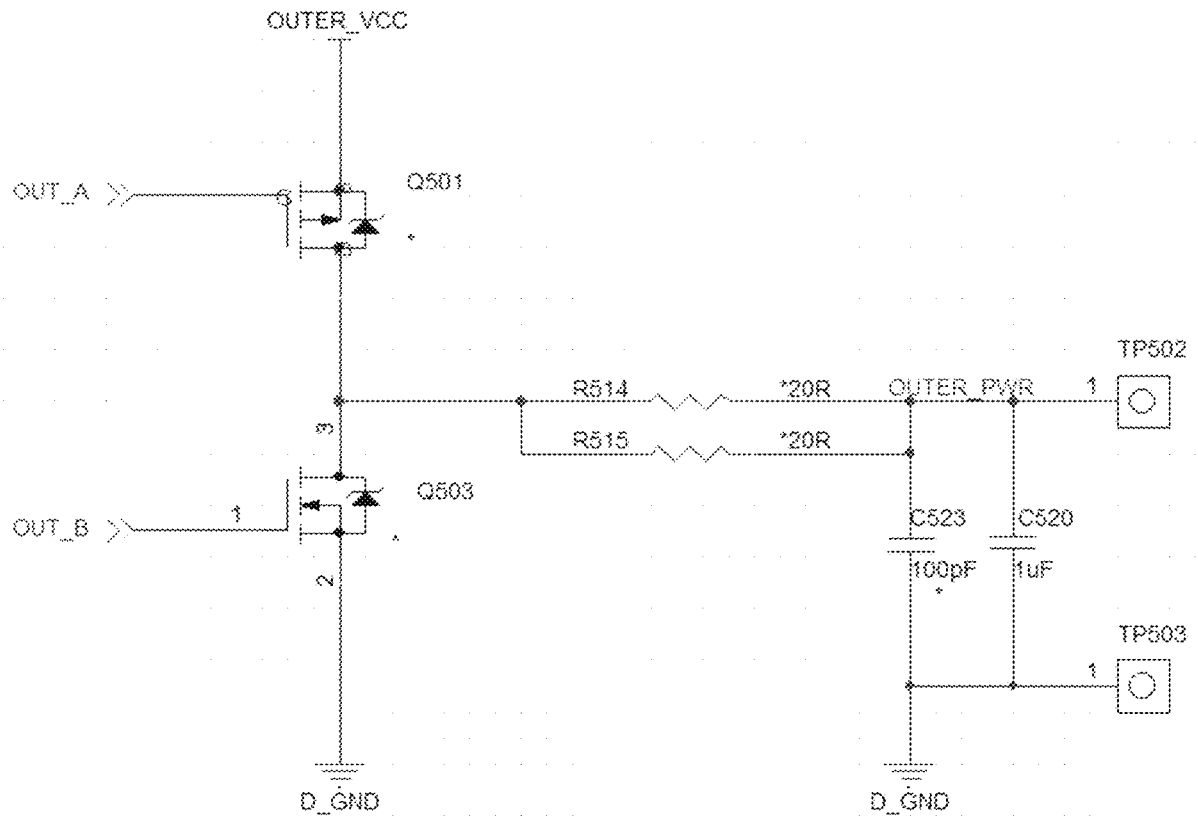
Figure 11:
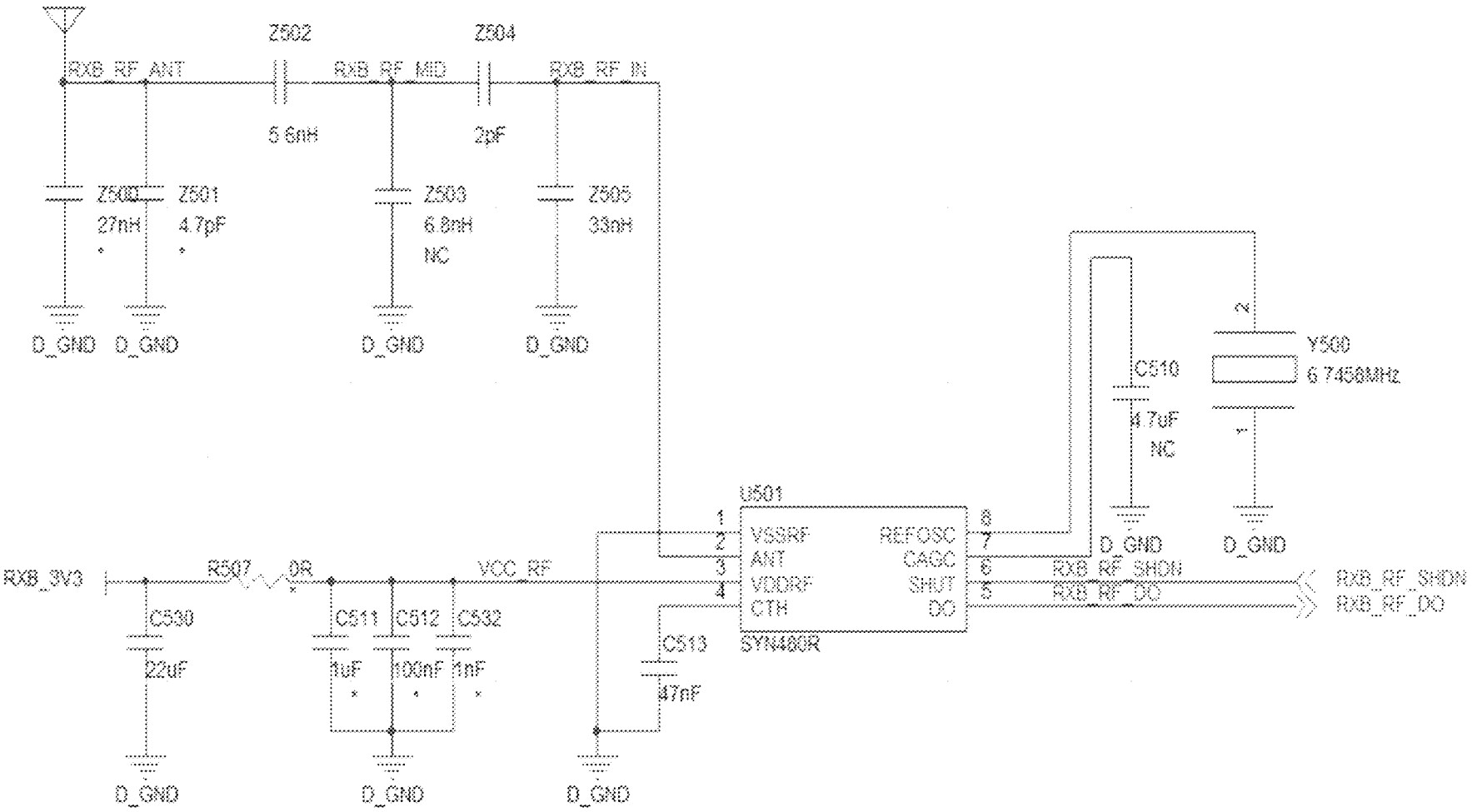
Figure 12:
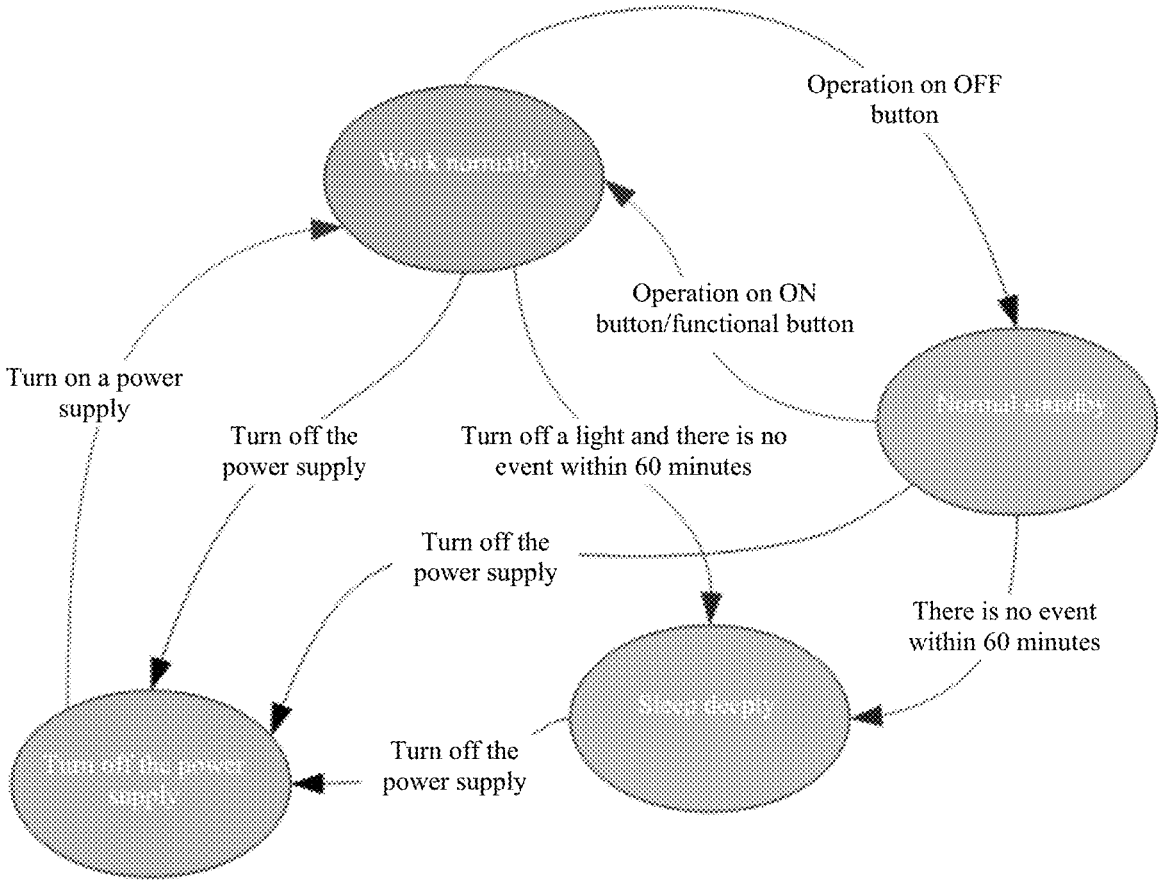

Bottom view 3 is a bottom view of a structure of a sandbag board of a lighting effect structure for a sandbag game board according to the utility model;

FIG. 4 is a schematic diagram of a structure of a vibration sensor of a lighting effect structure for a sandbag game board according to the utility model;

FIG. 5 is a schematic diagram of a structure of a control box of a lighting effect structure for a sandbag game board according to the utility model;

FIG. 6 is a schematic diagram of a structure of a circuit board of a lighting effect structure for a sandbag game board according to the utility model;

FIG. 7 is a schematic diagram of a structure of a remote control of a lighting effect structure for a sandbag game board according to the utility model;

FIG. 8 is a principle block diagram of a system of a lighting effect structure for a sandbag game board according to the utility model;

FIG. 9 is a block diagram of a programming architecture of system software of a lighting effect structure for a sandbag game board according to the utility model;

FIG. 10 is a diagram of a drive circuit of an LED driver of a lighting effect structure for a sandbag game board according to the utility model;

FIG. 11 is a diagram of a reception and demodulation circuit of a wireless signal of a lighting effect structure for a sandbag game board according to the utility model; and FIG. 12 is a schematic diagram of an energy-saving operation of a system of a lighting effect structure for a sandbag game board according to the utility model.

Reference numerals: 1: lighting effect assembly; 11: hole light strip; 12: board light strip; 13: sensing detection module; 131: sensor housing; 132: laser sensor; 133: through hole; 14: vibration detection module; 141: control box; 1411: circuit board; 142: wireless transceiver; 143: vibration sensor; 144: LED driver; 145: chip; 146: battery; 147: antenna; 148: power switch; 149: control box button; 15: voice playback module; 151: loudspeaker housing; 152: loudspeaker; 2: sandbag board; 3: remote control; 31: ON button; 32: OFF button; 33: TEAM A button; 34: TEAM B button; 35: button group; 36: SELECT button; 37: JUMP button; 38: TOGGLE button.

DESCRIPTION OF EMBODIMENTS

To understand the characteristics and technical content of embodiments of the present disclosure more clearly, implementations of embodiments of the present disclosure are described in detail below with reference to the accompanying drawings. The accompanying drawings thereof are only for reference and do not constitute an undue limitation to embodiments of the present disclosure. In the following description, for the sake of convenience, many details are illustrated to provide an adequate understanding of embodiments. However, one or more embodiments can also be implemented without these details. In other cases, to simplify drawings, well-known structures and apparatuses can be simplified for display.

The terms "first", "second", and so on in the description and claims of embodiments of the present disclosure are intended to distinguish between similar objects but do not necessarily indicate a specific order or sequence. It should be understood that the data termed in such a way is interchangeable in proper circumstances such that embodiments of the present disclosure described herein can be implemented in other orders than the order illustrated or described herein. Moreover, the terms "include", "have", and any variations thereof mean to cover non-exclusive inclusion.

It should be noted that, in embodiments of the present disclosure, the terms such as "upper", "lower", "inside", "middle", "outside", "front", and "rear" indicate the orientation or positional relationship shown in the accompanying drawings. These terms are mainly intended to better describe embodiments of the present disclosure, rather than to define that the devices, elements, and components indicated must have the specific orientation or be constructed and operated in the specific orientation. Besides, some of the terms mentioned above may be used to indicate other meanings in addition to indicating the orientation or positional relations. For example, the term "upper" may also be used to indicate an attachment relationship or a connection relationship in some cases. Those of ordinary skill in the art may understand specific meanings of the foregoing terms in embodiments of the present disclosure according to specific circumstances.

In addition, terms such as "arrangement", "connection", and "fixation" should be understood in a broad sense. For example, "connection" may be a fixed connection, a detachable connection, or an integrated structure; may be a mechanical connection or an electrical connection; may be a direct connection or an indirect connection via an intermediate medium; or may be intercommunication between two devices, elements, or components. Those of ordinary skill in the art may understand specific meanings of the foregoing terms in embodiments of the present disclosure according to specific circumstances.

It should be noted that, if there is no conflict, the following embodiments and features in embodiments of the present disclosure may be mutually combined.

Figure 1:
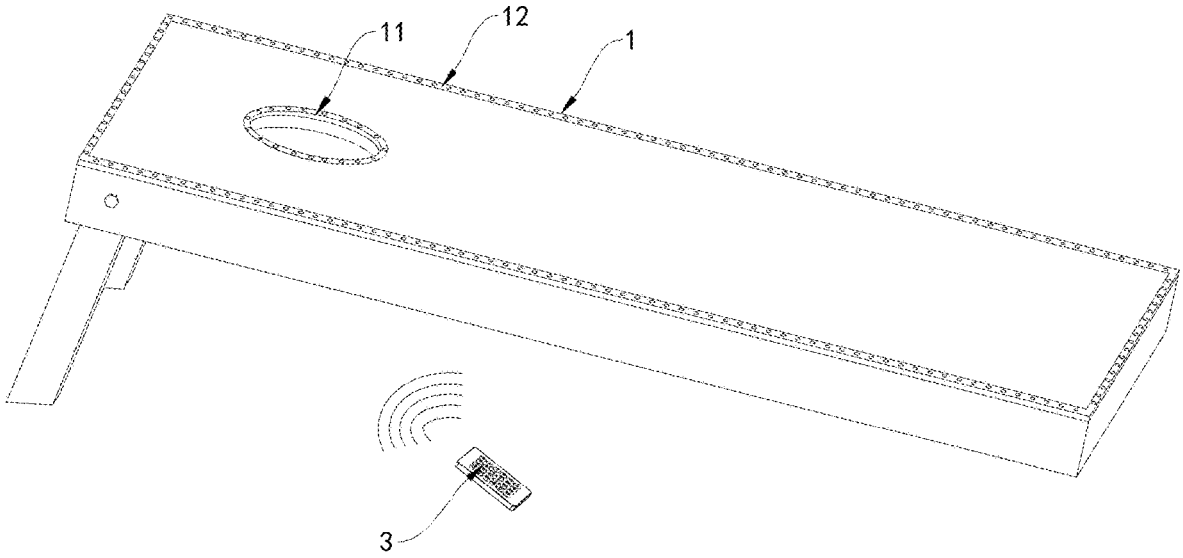
FIG. 1 is a schematic diagram of a structure of a lighting effect structure for a sandbag game board according to the utility model.
Figure 2:
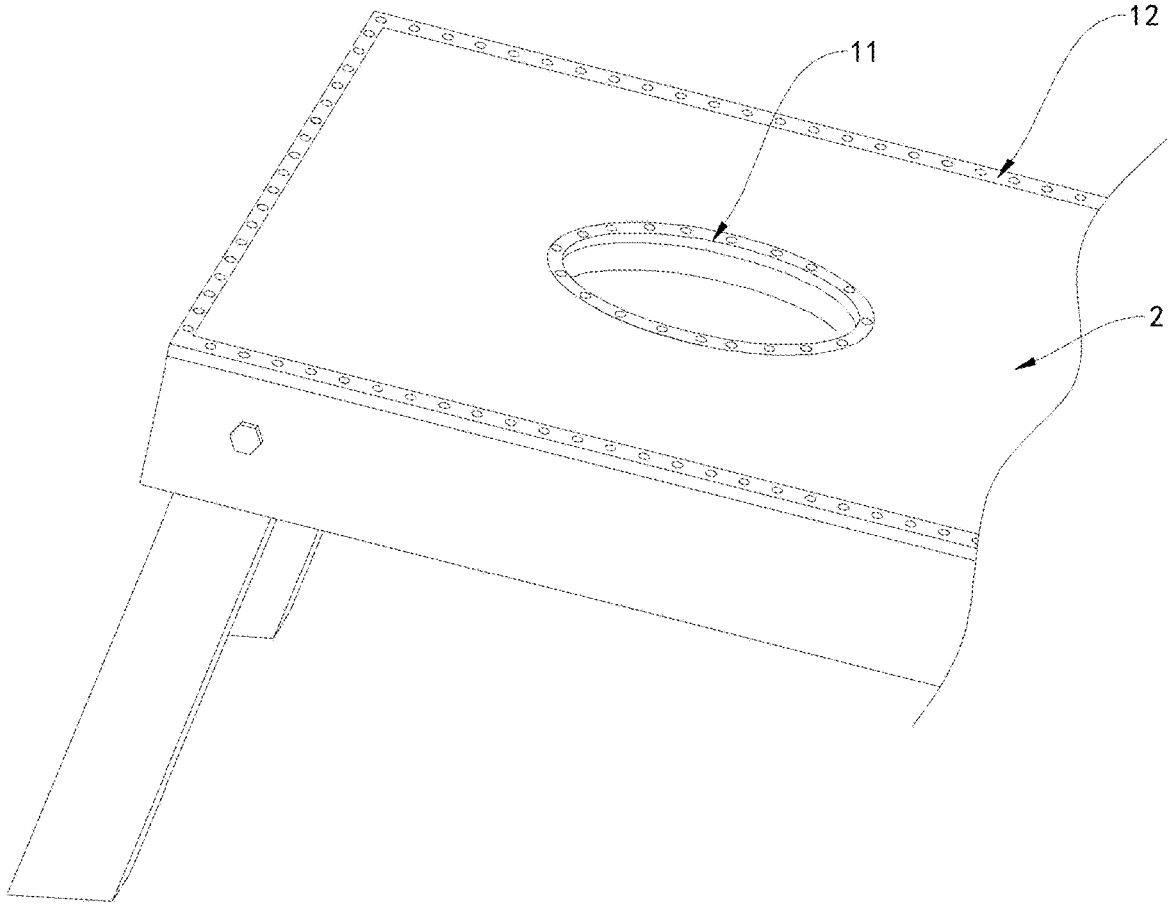
FIG. 2 is a schematic diagram of a structure of a sandbag board of a lighting effect structure for a sandbag game board according to the utility model.
Figure 3:
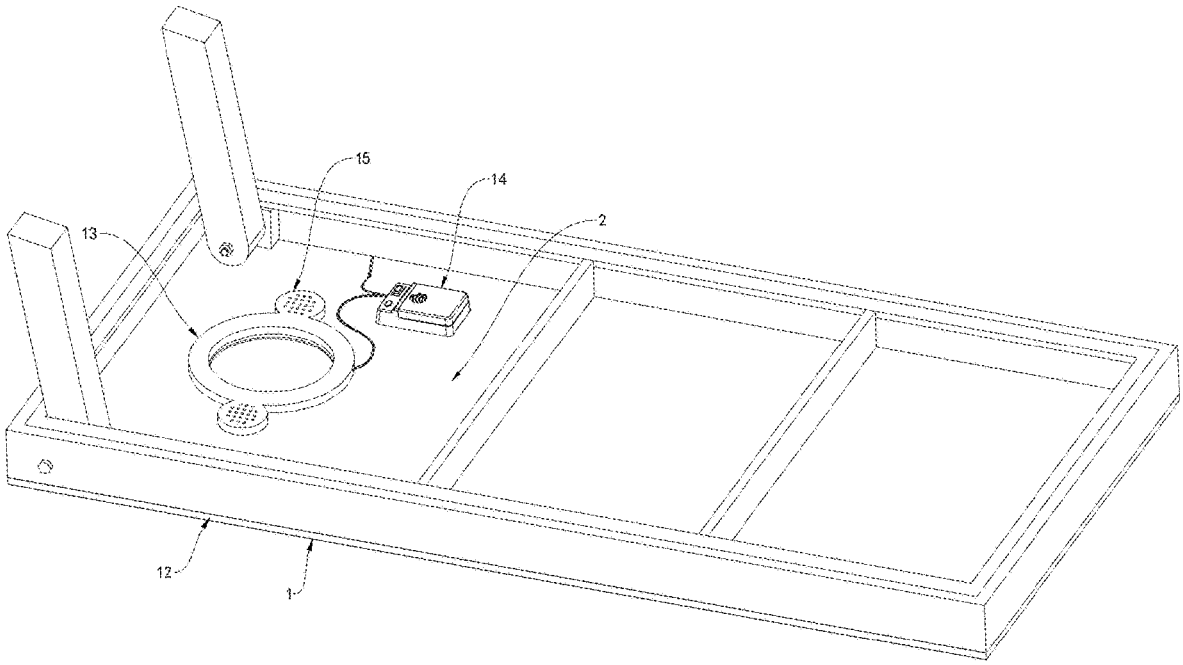

Refer to FIG. 1 to FIG. 12. A lighting effect structure for a sandbag game board includes a lighting effect assembly 1, a sandbag board 2 configured to mount the lighting effect assembly 1, and a remote control 3 configured to remotely control the lighting effect assembly 1. The lighting effect assembly 1 includes a hole light strip 11, a board light strip 12, a sensing detection module 13 configured to detect that a sandbag enters a hole, a vibration detection module 14 configured to detect that the sandbag hits a board, and a voice playback module 15 configured to perform voice prompt in cooperation with the sensing detection module 13 and the vibration detection module 14. The hole light strip 11 is embedded in an inner part of a hole on the sandbag board 2, the board light strip 12 is embedded at an outer edge of the sandbag board 2, and top levels of the hole light strip 11 and the board light strip 12 are the same as a top level of the sandbag board 2. As shown in FIG. 1 and FIG. 2, due to an embedded design of the hole light strip 11 and the board light strip 12, tops of the hole light strip 11 and the board light strip 12 are maintained at a same horizontal height with a top of the sandbag board 2. This ensures cooperation between the hole light strip 11 and the board light strip 12 each and the sandbag board 2, ensures appearance of the sandbag board 2, and is smooth and comfortable to touch, and is conducive to carry and transport.

As a specific technical solution of this embodiment, the sensing detection module 13 includes a sensor housing 131 disposed at a bottom of the sandbag board 2, and a plurality of laser sensors 132 disposed in an inner part of the sensor housing 131. A through hole 133 matching with the hole on the sandbag board 2 is opened in the inner part of the sensor housing 131, and the plurality of laser sensors 132 are disposed on a circle of the through hole 133. Due to disposing of the laser sensor 132 and the vibration sensor 143, it can detect when the sandbag hits the sandbag board 2 or enters the hole. In cooperation with the remote control 3 and the chip 145, lighting effect of the hole light strip 11 and the board light strip 12 are adjusted, and user-defined lighting effect can be displayed when an action of the sandbag is detected.

As a specific technical solution of this embodiment, the voice playback module 15 includes a loudspeaker housing 151 disposed on the sensor housing 131, a loudspeaker 152 is disposed in the loudspeaker housing 151, and there is at least one loudspeaker housing 151.

As a specific technical solution of this embodiment, the vibration detection module 14 includes a control box 141 disposed at the bottom of the sandbag board 2, a circuit board 1411 is disposed in an inner part of the control box 141, and a wireless transceiver 142, a vibration sensor 143, an LED driver 144, and a chip 145 are integrated on the circuit board 1411.

As a specific technical solution of this embodiment, a battery 146 that is connected to the circuit board 1411 through a circuit is further disposed in the inner part of the control box 141, and the hole light strip 11 and the board light strip 12 are connected to the LED driver 144 and the chip 145 through a circuit.

As a specific technical solution of this embodiment, the laser sensor 132 and the loudspeaker 152 are connected to the chip 145 through a circuit. The chip 145 is a MCU, and is responsible for running a program of a system. The chip determines, by collecting data from the vibration sensor 143 and the laser sensor 132, whether there is a sandbagging event, drives, through the LED driver 144, the hole light strip 11 and the board light strip 12 to display lighting effect, and finally provides feedback information to a user. The feedback information is provided by different colors and blinking of the hole light strip 11 and the board light strip 12. The different feedback information may be set through the remote control 3. A wireless signal sent by the remote control 3 is received by an antenna 147 of the circuit board 1411, and demodulated by the wireless transceiver 142, to output a baseband signal to the chip 145 for processing and setting different user feedback signals. To facilitate an operation of the user without the remote control 3, the control box 141 further has a control box button 149.

A function of the control box button 149 is to switch the lighting effect of the hole light strip 11 and the board light strip 12 without the remote control 3.

Before power on: When the control box button 149 is pressed and held first, the power switch 148 is turned on, and the sandbag board 2 does not receive an operation of the remote control 3, it is in a pure manual mode.

After Power on:

Long press: Circularly switching between three control objects: "hole light strip 11", "board light strip 12", and "hole light strip 11+board light strip 12". A selected control object blinks, and a control object is switched once every 1 s. After an object to be set (such as the board light strip 12) by long pressing, and a hand is released, a color is selected by short pressing.

Functions of the power switch 148: Turn on the power supply to power on the system; turn off the power supply to power off the system; and reboot: reboot the system to recover when in doubt.

As a specific technical solution of this embodiment, an antenna 147 that is matched with the wireless transceiver 142 is further integrated on the circuit board 1411, and the circuit board 1411 is wirelessly connected to the remote control 3 through the wireless transceiver 142 and the antenna 147.

As a specific technical solution of this embodiment, a power switch 148 that is configured to switch on and off power supplies of the battery 146 and the circuit board 1411, and a control box button 149 that is configured to set lighting effect of the hole light strip 11 and the board light strip 12 are disposed on a side of the control box 141, and the power switch 148 and the control box button 149 are connected to the chip 145 through a circuit.

As a specific technical solution of this embodiment, an ON button 31 configured to enable a control box 141 and an OFF button 32 configured to disable a detection function are disposed on the remote control 3, a SELECT button 36 is disposed on the remote control 3, and the SELECT button 36 is configured to switch lighting effects of the hole light strip 11 and the board light strip 12. At least one button group 35 that is configured to set a color of the hole light strip 11 and the board light strip 12, and a TEAM A button 33 and a TEAM B button 34 that are configured to group a versus mode are disposed on the remote control 3. The button group 35 includes a R button, a G button, and a B button. The R button, the G button, and the B button are respectively corresponding to three colors: red, green, and blue. A TOGGLE button 38 and a JUMP button 37 are further disposed on the remote control 3.

The apparatus has two modes: a versus mode and a stand-alone mode.

Versus Mode:

Turn on the power switch 148 to select the versus mode, and press the "TEAM A button 33" and the "TEAM B button 34" to adjust and set lighting effect of the TEAM A button 33. Press the "SELECT button 36" to select a hole light strip 11 or a board light strip 12 to be adjusted, and press a color button in an area of the "R button, G button, and B button" to set a color. Press the "JUMP button 37" to set to a running light mode. Similarly, press the "TEAM B button 34" set to the running light mode.

Stand-Alone Mode:

Wait for the power on or directly press a button other than the "TEAM A button 33" and the "TEAM B button 34" to directly enter the stand-alone mode.

Functions of each button: ON button: The ON button is used to open the system. After the system works, in the "hole light strip 11+the board light strip 12" mode, the white light blinks for 1 s). If it is a grouped sandbag board 2, immediately press the group blinking light (for a group A, the yellow light blinks, and for a group B, the purple light blinks).

OFF button: After the OFF button is pressed, the system enters a low-power state. In this case, the system has no detection function, but can receive operations of the remote control 3 and the control box button 149, to reopen the system. Several methods for awaking from the low-power state: Press the ON button on the remote control 3; operate the control box button 149 by hands; press the TEAM A button 33 or the TEAM B button 34 to enable a corresponding group; operate the power switch 148 by hands to re-power on after powering off. A difference among the methods lies in that re-powering on clears group information of the remote control 3.

TEAM A button 33: Within 10 S after powering on, press the button to set a current sandbag board 2 to a group A. During a normal operation, press the button to select a sandbag board 2 of an operation group A. A yellow light of the sandbag board 2 of the selected group A blinks. When the operation is not allowed, a red light blinks. In a power-off state, after the button is pressed, the sandbag board 2 of the group A starts while a group B does not start.

TEAM B button 34: Within 10 S after powering on, press the button to set a current sandbag board 2 to a group B. During a normal operation, press the button to select a sandbag board 2 of an operation group B. A purple light of the sandbag board 2 of the selected group B blinks. When the operation is not allowed, a red light blinks. In a power-off state, after the button is pressed, the sandbag board 2 of the group B starts while a group A does not start.

SELECT button 36 (selection button): Circularly switching among "hole light strip 11", "board light strip 12", and "hole light strip 11+board light strip 12" to select an object with a color to be set. The selected object blinks. If the user does not operate continuously for more than 10 s, the mode is automatically switched to "hole light strip 11+board light strip 12", which is equivalent that two lights are operated at the same time by default if a position of an operated light is not selected, to reduce the number of times of operations.

JUMP button 37 (running light button): The button provides a running light function, and is used to switch among three modes.

TOGGLE button 38 (flip button): After the button is pressed each time, a selected light is "on" or "off" once.

Color button: Set a color of a selected "hole light strip 11 or board light strip 12" through the R button, the G button, the B button, and another color button on the remote control 3.

It should be noted that when the sandbag board 2 vibrates, only a reminder light for the "board light strip 12" appears. When the sandbag enters the hole, reminder lights for the hole light strip 11 and the board light strip 12 appear, and the loudspeaker 152 is triggered while the laser sensor 132 and the vibration sensor 143 are triggered, and used to program playback content of the loudspeaker 152 through the chip 145. When the sandbag enters the hole to trigger the laser sensor 132, content of celebration may be played back. When the sandbag hits the sandbag board 2 to trigger the vibration sensor 143, content of a failure may be played back.

Descriptions for a prompting state of the hole light strip 11 and the board light strip 12:

A white light is normal on for 1 s: Power on or open the system.

A yellow light blinks: The sandbag board 2 of the group A is selected.

A purple light blinks: The sandbag board 2 of the group B is selected.

A red light blinks: Prohibit an operation of the remote control 3. For example, an operation on the TEAM A button 33 or the TEAM B button 34 is invalid after powering-on for 10 s.

When a blinking light selected by using the SELECT button 36 is used, a blinking color of the blinking light is determined by a color of a current light, and apparent flashing frequency is different from that of prompting lights in the foregoing several prompting states.

Refer to FIG. 9. When a power switch 148 of the system is turned on, the system is powered on, and software starts executing code. The system first initializes a GPIO of the chip 145 and then performs initialization of the vibration sensor 143 and the laser sensor 132, and the system enters an infinite task cycle. In this cycle, the system monitors input states of an input button and the wireless transceiver 142. If there is an input of the user, the system processes input information of the user, and adjusts feedback states of the hole light strip 11 and the board light strip 12, such as changing a color or brightness, or the like. When there is no input of the user, the software continues to collect signals from the vibration sensor 143 and the laser sensor 132, and determines, according to a software algorithm, whether there is a sandbagging event. If there is a sandbagging event, the event is displayed based on a state configured by the user in a manner of driving the hole light strip 11 and the board light strip 12 through the LED driver 144, and a next cycle is proceeded.

FIG. 10 is a diagram of a drive circuit of the LED driver 144. OUTER_VCC is a power supply, OUT_A and OUT_B are control signals, TP502 and TP503 are output spot welds of the LED light, Q501 is a PMOS transistor, and Q503 is a NMOS transistor. When OUT_A is low and OUT_B is low, an output of the LED light is at a high level. When OUT_A is high and OUT_B is high, the output of the LED light is at low level. It is not allowed that OUT_A is low and OUT_B is high. Two 20 ohm resistors are connected in parallel, to increase output power of the LED light. Two capacitors at an outlet are designed to reduce EMC.

FIG. 11 is a diagram of a reception and demodulation circuit of a wireless signal. The wireless signal enters U501 through an antenna 147 for demodulation, and then is processed through a RXB_RF_DO input chip 145, to obtain operation information of the user.

As shown in FIG. 12, to save a battery 146 and provide enough energy for the system, the system works based on a state in FIG. 12.

Normal mode: The system lights up normally, a detection function is enabled, system power consumption is maximum, and four AA batteries 146 work normally for about 48 hours. In the normal mode, if all the lights are turned off and only the detection function is enabled, if the system does not detect the sandbagging event or a button operation of the remote control 3 within 60 consecutive minutes, the automatically enters a deep sleep state, to save energy of the battery 146.

Normal standby mode: The system is shut down through the OFF button 32 of the remote control 3. Within 60 minutes, if the system is opened through the ON button 31 on the remote control 3 again, or returns to a normal functional mode through the control box button 149, an operating current of the system in standby is much lower than that of the system in a normal operating mode (note: About two thousandths of the energy of the AA battery 146 is consumed within the 60 minutes). In the normal standby mode, the system may be opened again through the ON button 31 on the remote control 3 or the control box button 149.

Deep sleep mode: The deep sleep mode is an extremely low-power mode, and 10% of the energy of the AA battery 146 is enough to maintain the system for two to three years. This consumption may be lower than consumption of self-discharge of the AA battery 146. After entering the deep sleep mode, the system needs to be re-powered for restart.

Power off mode: The power switch 148 is disconnected, the system is disconnected from the battery 146, and no energy of the battery 146 is consumed.

In use, when the sandbag is thrown on the sandbag board 2, information about a vibration of the sandbag board 2 is collected by the vibration sensor 143 in the control box 141, and then the information is transmitted to the chip 145. The hole light strip 11 and the board light strip 12 display lighting effect by the chip 145 based on a programmed program. In addition, the loudspeaker 152 cooperates with the vibration sensor 143 to play back the content of a failure.

When the sandbag enters the hole light strip 11, the laser sensor 132 detects the sandbag and feeds back data to the chip 145, and the hole light strip 11 and the board light strip 12 display lighting effect by the chip 145 controlling the programmed program. In addition, the loudspeaker 152 cooperates with the vibration sensor 143 to play back the content of a celebration.

In programming logic, the chip 145 first processes information that the sandbag enters the hole and that comes from the laser sensor 132, and then processes vibration information from the vibration sensor 143. Therefore, a lighting effect display demand that the sandbag first hits the sandbag board 2 and then slides into the hole can be effectively processed, to complete an operation on the apparatus.

In conclusion, according to the lighting effect structure for a sandbag game board, that is, the design that the hole light strip 11 and the board light strip 12 are embedded in the sandbag board 2, appearance of the sandbag board 2 is ensured. Due to disposing of the hole light strip 11, the board light strip 12, the laser sensor 132, the vibration sensor 143, and the loudspeaker 152, the lighting effect is displayed and a corresponding voice prompt is played back while the sandbag hits the sandbag board 2 or entering the hole. Therefore, interactivity is high, and interestingness of a sandbag throwing game is improved.

It should be noted that terms "including", "comprising", or any other variants thereof are intended to cover non-exclusive inclusion, such that a process, method, article, or device including a series of elements includes not only those elements but also other elements not explicitly listed, or elements inherent to such a process, method, article, or device. In case there are no more restrictions, an element limited by the statement "including a . . . " does not exclude the presence of additional identical elements in the process, the method, the article, or the device that includes the element.

Although embodiments of the utility model have been illustrated and described above, those of ordinary skill in the art can understand that various changes, modifications, replacements, and alterations may be made to these embodiments without departing from the principle and spirit of the utility model, and the scope of the utility model is defined by the claims and equivalents thereof.

The invention claimed is:

1. A lighting effect structure for a sandbag game board, comprising a lighting effect assembly (1), a sandbag board (2) configured to mount the lighting effect assembly (1), and a remote control (3) configured to remotely control the lighting effect assembly (1), wherein the lighting effect assembly (1) comprises a hole light strip (11), a board light strip (12), a sensing detection module (13) configured to detect that a sandbag enters a hole, a vibration detection module (14) configured to detect that the sandbag hits a board, and a voice playback module (15) configured to perform voice prompt in cooperation with the sensing detection module (13) and the vibration detection module (14), the hole light strip (11) is embedded in an inner part of a hole on the sandbag board (2), the board light strip (12) is embedded at an outer edge of the sandbag board (2), and top levels of the hole light strip (11) and the board light strip (12) are the same as a top level of the sandbag board (2).

2. The lighting effect structure for a sandbag game board according to claim 1, wherein the sensing detection module (13) comprises a sensor housing (131) disposed at a bottom of the sandbag board (2), and a plurality of laser sensors (132) disposed in an inner part of the sensor housing (131), a through hole (133) matching with the hole on the sandbag board (2) is opened in the inner part of the sensor housing (131), and the plurality of laser sensors (132) are disposed on a circle of the through hole (133).

3. The lighting effect structure for a sandbag game board according to claim 2, wherein the voice playback module (15) comprises a loudspeaker housing (151) disposed on the sensor housing (131), a loudspeaker (152) is disposed in the loudspeaker housing (151), and there is at least one loudspeaker housing (151).

4. The lighting effect structure for a sandbag game board according to claim 3, wherein the vibration detection module (14) comprises a control box (141) disposed at the bottom of the sandbag board (2), a circuit board (1411) is disposed in an inner part of the control box (141), and a wireless transceiver (142), a vibration sensor (143), an LED driver (144), and a chip (145) are integrated on the circuit board (1411).

5. The lighting effect structure for a sandbag game board according to claim 4, wherein a battery (146) that is connected to the circuit board (1411) through a circuit is further disposed in the inner part of the control box (141), and the hole light strip (11) and the board light strip (12) are connected to the LED driver (144) and the chip (145) through a circuit.

6. The lighting effect structure for a sandbag game board according to claim 5, wherein the laser sensor (132) and the loudspeaker (152) are connected to the chip (145) through a circuit.

7. The lighting effect structure for a sandbag game board according to claim 6, wherein an antenna (147) that is matched with the wireless transceiver (142) is further integrated on the circuit board (1411), and the circuit board (1411) is wirelessly connected to the remote control (3) through the wireless transceiver (142) and the antenna (147).

8. The lighting effect structure for a sandbag game board according to claim 7, wherein a power switch (148) that is configured to switch on and off power supplies of the battery (146) and the circuit board (1411), and a control box button (149) that is configured to set lighting effect of the hole light strip (11) and the board light strip (12) are disposed on a side of the control box (141), and the power switch (148) and the control box button (149) are connected to the chip (145) through a circuit.

9. The lighting effect structure for a sandbag game board according to claim 1, wherein an ON button (31) configured to enable a control box (141) and an OFF button (32) configured to disable a detection function are disposed on the remote control (3), a SELECT button (36) is disposed on the remote control (3), and the SELECT button (36) is configured to switch lighting effects of the hole light strip (11) and the board light strip (12).

10. The lighting effect structure for a sandbag game board according to claim 1, wherein at least one button group (35) that is configured to set a color of the hole light strip (11) and the board light strip (12), and a TEAM A button (33) and a TEAM B button (34) that are configured to group a versus mode are disposed on the remote control (3).

* * * * *